US006645007B1

(12) United States Patent
Ko

(10) Patent No.: US 6,645,007 B1
(45) Date of Patent: Nov. 11, 2003

(54) VERTICALLY MATED MICRO COAXIAL CABLE CONNECTOR ASSEMBLY WITH GROUNDING BAR

(75) Inventor: David Tso-Chin Ko, Cypress, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/155,375

(22) Filed: May 24, 2002

(51) Int. Cl.[7] ..... H01R 13/648
(52) U.S. Cl. ..... 439/579; 439/610
(58) Field of Search ..... 439/497, 579, 439/610

(56) References Cited

U.S. PATENT DOCUMENTS 6,123,582 A * 9/2000 Ko et al. ..... 439/579
6,210,230 B1 * 4/2001 Lai ..... 439/610
6,305,978 B1 * 10/2001 Ko et al. ..... 439/610

* cited by examiner

*Primary Examiner*—Gary Paumen
(74) *Attorney, Agent, or Firm*—Wei Te Chung

(57) ABSTRACT

A micro coaxial cable connector assembly (1) includes a micro coaxial cable connector (10), a plurality of wire cables (20), an upper grounding shield (30), a lower grounding shield (40), a top grounding bar (60) and a bottom grounding bar (62). The micro coaxial cable connector includes a mating portion (101), a plurality of signal and grounding terminals (102) received in the mating portion and a base (103) perpendicular to the mating portion. The upper grounding shield is assembled to the mating portion. The lower grounding shield is assembled to the base. The bottom grounding bar electrically connecting metal braiding of the wires and includes a plurality of grounding fingers (623) soldered to the grounding terminals.

1 Claim, 7 Drawing Sheets

VERTICALLY MATED MICRO COAXIAL CABLE CONNECTOR ASSEMBLY WITH GROUNDING BAR

CROSS-REFERENCES TO RELATED APPLICATIONS

This patent application is a Application of patent applications with Ser. Nos. 10/155, 393, 10/155, 758 and 10/155, 747 respectively entitled "VERTICALLY MATED MICRO COAXIAL CABLE CONNECTOR ASSEMBLY", "VERTICALLY MATED MICRO COAXIAL CABLE CONNECTOR ASSEMBLY", and "VERTICALLY MATED MICRO COAXIAL CABLE CONNECTOR ASSEMBLY WITH GROUNDING SHIELD", all invented by the same inventors as this patent application, all assigned to the same assignee and filed on the same date with this application.

1. Field of the Invention

The present invention relates to a micro coaxial cable connector assembly, and particularly to a micro coaxial cable connector assembly for electrically connecting with a header vertically mounted on a printed circuit board.

2. The Related Arts

In U.S. Pat. No. 6,123,582, a micro coaxial cable connector assembly for contacting with a mating electrical connector includes a first and a second housing members, a cable with a plurality of wires, an upper and a lower shield members, and a plurality of contacts. Each wire has a central signal conductor and a grounding braiding around the signal conductor. The connector assembly is horizontally mated with the mating connector. A grounding bar is soldered to the grounding braiding of the wires. The upper and lower shield members attached onto the first housing member are engagingly jointed with each other and electrically contact with a shield member of the mating connector. Meanwhile, the upper shield member further forms a plurality of spring fingers extending inside the first housing member to electrically engage with the grounding bar received therein. Therefore, a grounding path from the cables to the mating connector is established. This type of the micro coaxial cable connector assembly is usually used to connect a Liquid Crystal Display (LCD) with a main board of a notebook computer on which the mating connector is horizontally mounted.

In some applications, there is a necessity to mate a micro coaxial cable connector assembly in a vertical direction with a vertically mounted header. Under this circumstance, a micro coaxial cable connector assembly having a new structure is needed.

SUMMARY OF THE INVENTION

Accordingly, an object of the present invention is to provide an improved micro coaxial cable connector assembly for mating with a header vertically mounted on a printed circuit board, in which the connector assembly has a grounding shield with an improved structure for firmly assembling with a housing of the connector assembly and providing a reliable grounding effectiveness.

Another object of the present invention is to provide a micro coaxial cable connector assembly for mating with a vertically mounted header, in which wires of a cable of the connector assembly can be easily and firmly connected to a connector of the assembly.

To achieve the above objects, a micro coaxial cable connector assembly in accordance with the present invention comprises a micro coaxial cable connector comprising a mating portion for mating with a header on a printed circuit board in a vertical direction and a base perpendicular to the mating portion, a plurality of terminals received in the mating portion, and a plurality of wires assembled to the base of the connector. Each wire comprises a conductor electrically connecting with a corresponding terminal. An upper grounding shield is assembled to the mating portion of the connector in a first direction and a lower grounding shield comprising a plate portion is assembled to a bottom of the base of the connector in a second direction perpendicular to the first direction. The lower grounding shield electrically connects with the upper grounding shield.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
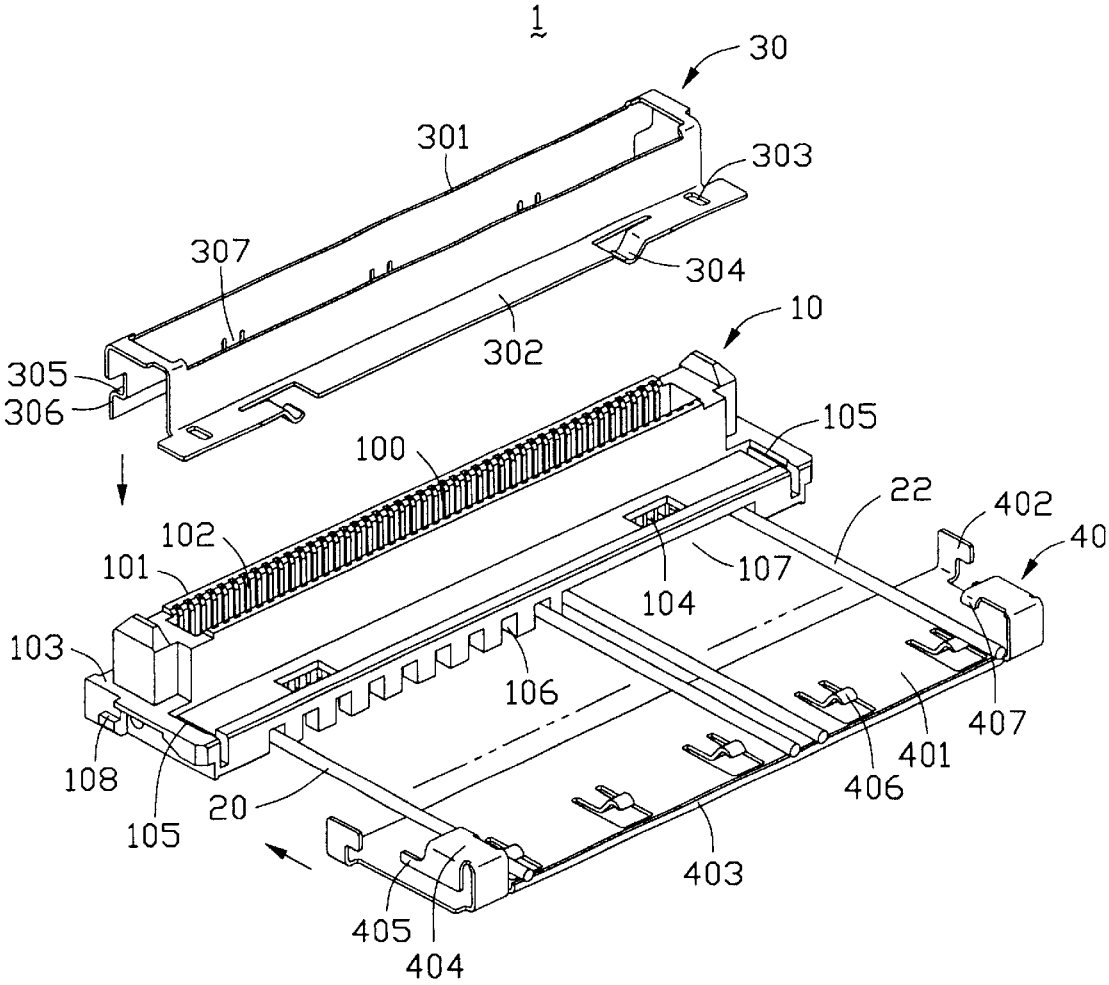
FIG. 1 is an explode perspective view of a micro coaxial cable connector assembly in accordance with the present.

With reference to the drawings and particularly to FIGS. 1–4, a micro coaxial cable connector assembly 1 constructed in accordance with the present invention comprises a connector 10, a flat cable comprising a group of first wires 20 for transmitting signals and a group pf second wires 22 for transmitting power, an upper grounding shield 30 and a lower grounding shield 40.

Figure 2:
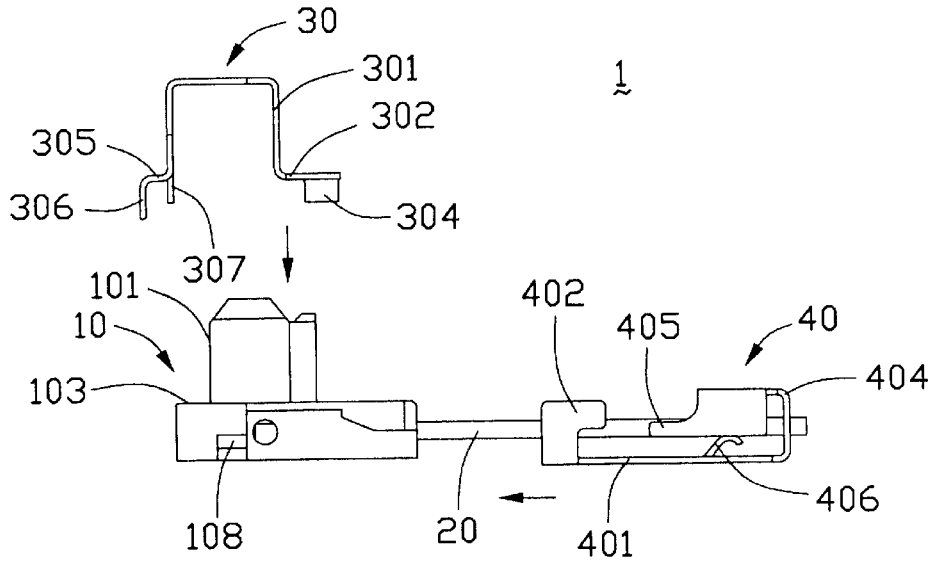
FIG. 2 is a side view of the micro coaxial cable connector assembly of FIG. 1.
Figure 3:
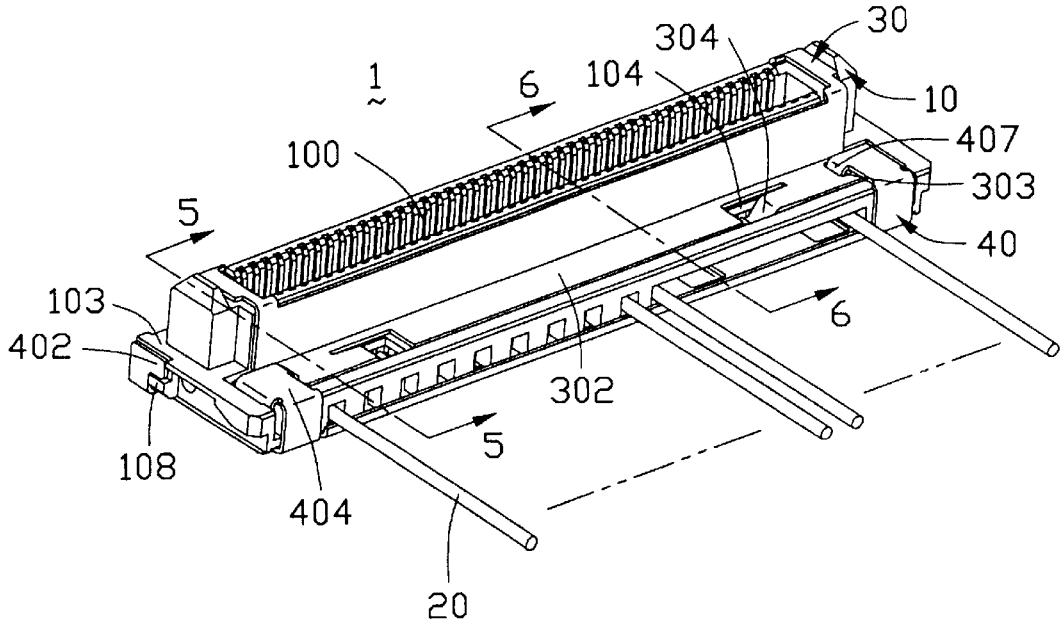
FIG. 3 is an assembled perspective view of the micro coaxial cable connector assembly of FIG. 1.
Figure 4:
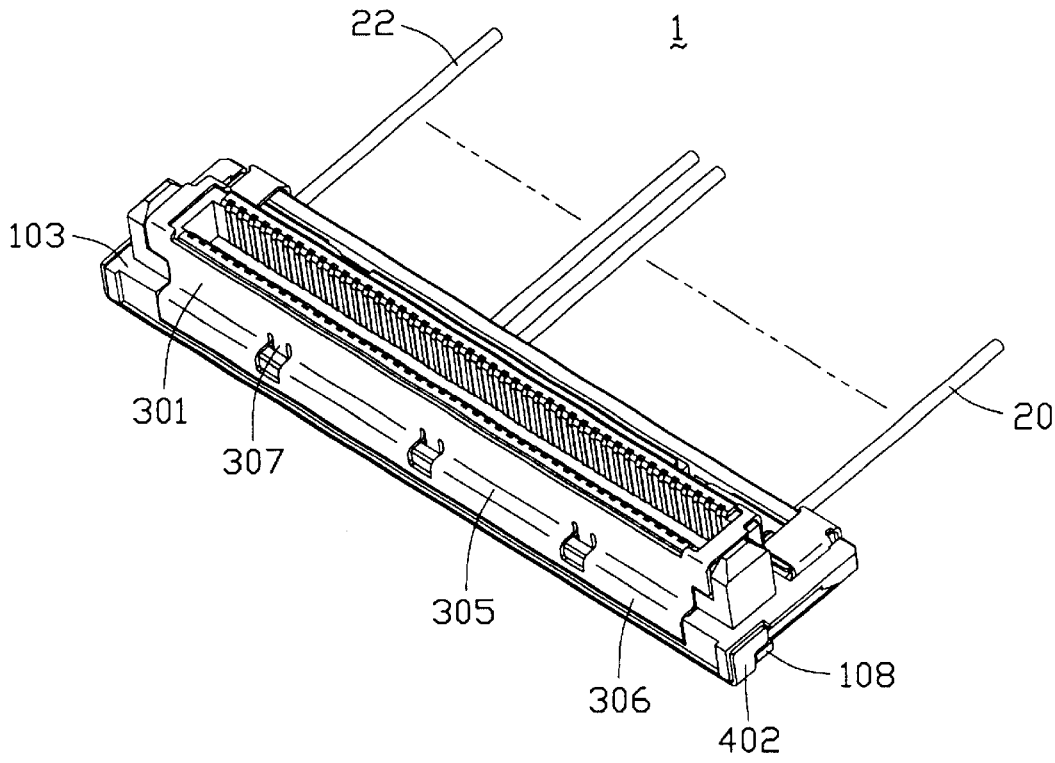
FIG. 4 is a view similar to FIG. 3, viewed from another aspect.
Figure 5:
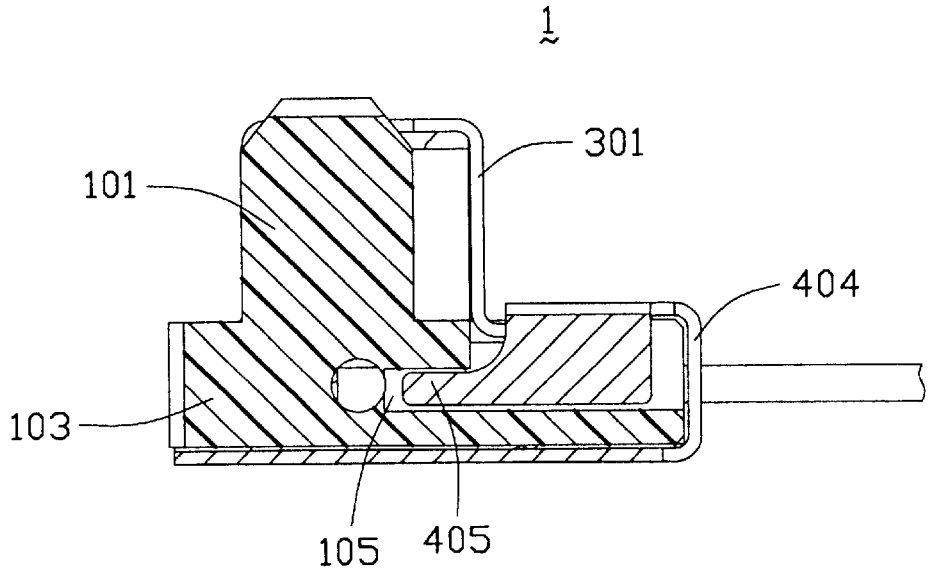
FIG. 5 is a cross-sectional view of the micro coaxial cable connector assembly taken along line 5—5 of FIG. 3.

Referring to FIGS. 1 and 2, the connector 10 comprises a mating portion 101 for mating with a corresponding complementary connector (not shown) which is a vertical header mounted on a printed circuit board, a plurality of terminals 102 received in the mating portion 101 and a base 103 perpendicular to the mating portion 101. The mating portion 101 has a recess 100 opening upwardly for receiving the complementary connector. The base 103 defines a pair of recesses 104 through top and bottom faces (not labeled) of a front side of the base 103. Referring to FIG. 5, a pair of elongate slots 105 is respectively defined in the base 103 adjacent to lateral ends of the base 103. The base 103 defines a plurality of grooves 106 in the bottom of the front side thereof. The grooves 106 are used for respectively receiving the first wires 20 therein. The base 103 also defines a channel 107 beside the grooves 106 for receiving the second wires 22 therein. In addition, the base 103 comprises a pair of protrusions 108 respectively laterally protruding from the lateral ends thereof.

Figure 6:
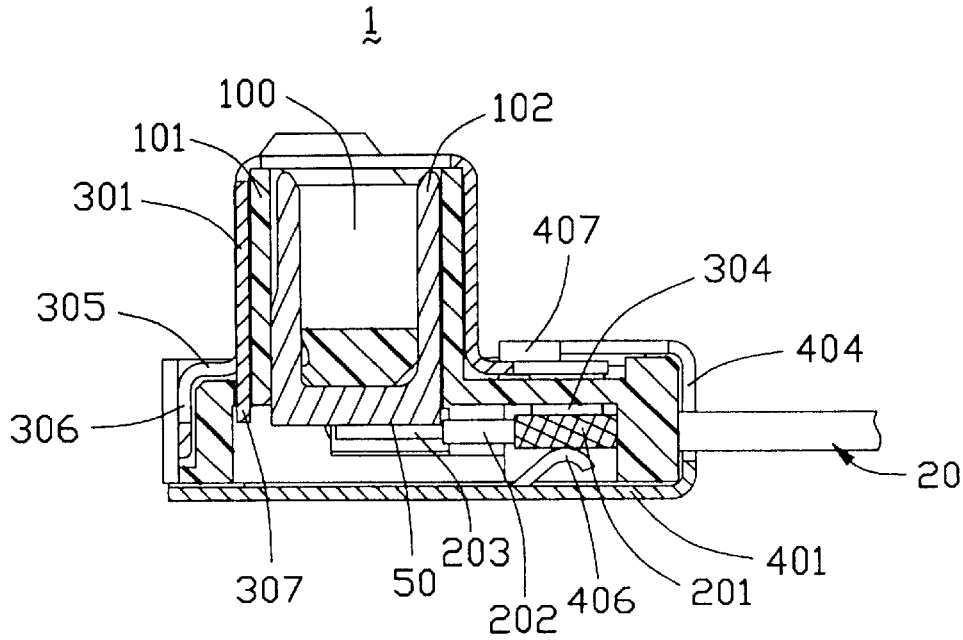
FIG. 6 is a cross-sectional view of the micro coaxial cable connector taken along line 6—6 of FIG. 3.

The upper grounding shield 30 generally has a U-shaped configuration and comprises a U-shaped portion 301 for covering the mating portion 101 of the connector 10, a flat portion 302 extending forwardly from a bottom of one side of the U-shaped portion 301 and a flat portion 305 extending from a bottom of the other side of the U-shaped portion 301, opposite the flat portion 302. The flat portion 302 defines a pair of rectangular holes 303 adjacent to lateral ends thereof, respectively. The flat portion 302 also forms a pair of downwardly extending spring tags 304 between the two rectangular holes 303. The spring tags 304 are received in the recesses 104 of the base 103, respectively. A vertical portion 306 extends downwardly from the flat portion 305. The U-shaped portion 301 also has a plurality of glossal portions 307 extending downward form the other side of the U-shaped portion 301 and into the base 103 (referring to FIGS. 4 and 6).

The lower grounding shield 40 comprises a plate portion 401, a pair of buckling portions 402 respectively extending upwardly from lateral ends of the plate portion 401, a bent edge 403 extending upward from a front side of the plate portion 401 and a pair of pressing portions 404 extending upwardly from the front side of the plate portion 403 beside the bent edge 403 and adjacent to the lateral ends of the plate portion 401, respectively. The plate portion 401 defines a plurality of tags 406 extending upwardly. Each pressing portion 404 has a latch 405 extending rearwards from an outer side thereof and a hook 407 extending downwardly from an inner side thereof.

Referring to FIGS. 3–6, the upper grounding shield 30 and the lower grounding shield 40 are assembled to the connector 10. First, the upper grounding shield 30 is assembled downwardly to the mating portion 101 of the connector 10 with the flat portion 302 of the U-shaped portion 301 located on the base 103 of the connector 10, the spring tags 304 of the flat portion 302 respectively received in the recesses 104 of the base 103, the flat portion 305 of the U-shaped portion 301 located on the base 103, the vertical portion 306 covering a rear side of the base 103, and the glossal portions 307 received in the base 103. Second, the lower grounding shield 40 is assembled rearwardly to the base 103 with the pressing portions 404 pressing on the flat portion 302 of the upper grounding shield 30, the latches 405 of the pressing portions 404 extending into and securely received into the slots 105 of the base 103 for preventing the pressing portions 404 from moving upwardly, the hooks 407 of the pressing portions 404 extending into the rectangular holes 303 of the upper grounding shield 30, the buckling portions 402 of the lower grounding shield 40 also respectively buckling to the protrusions 108 on the lateral ends of the base 103. Thus, the upper grounding shield 30, the connector 10, and the lower grounding shield 40 are securely assembled together. So a grounding path between the upper grounding shield 30 and the lower grounding shield 40 is established.

Figure 7:
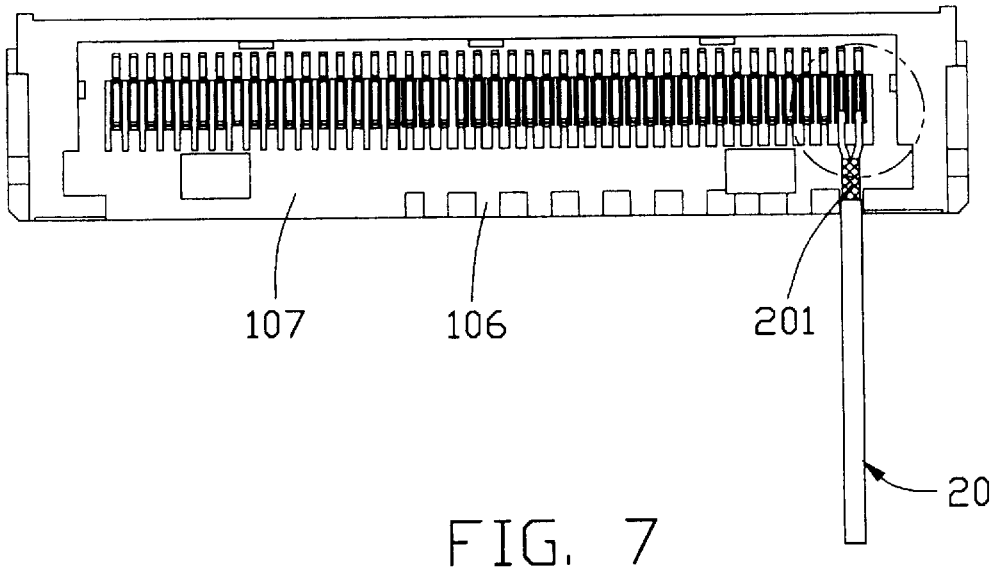
FIG. 7 is a bottom plan view of the micro coaxial cable connector assembly in which upper and lower grounding shields of the assembly being removed for clarity.
Figure 8:
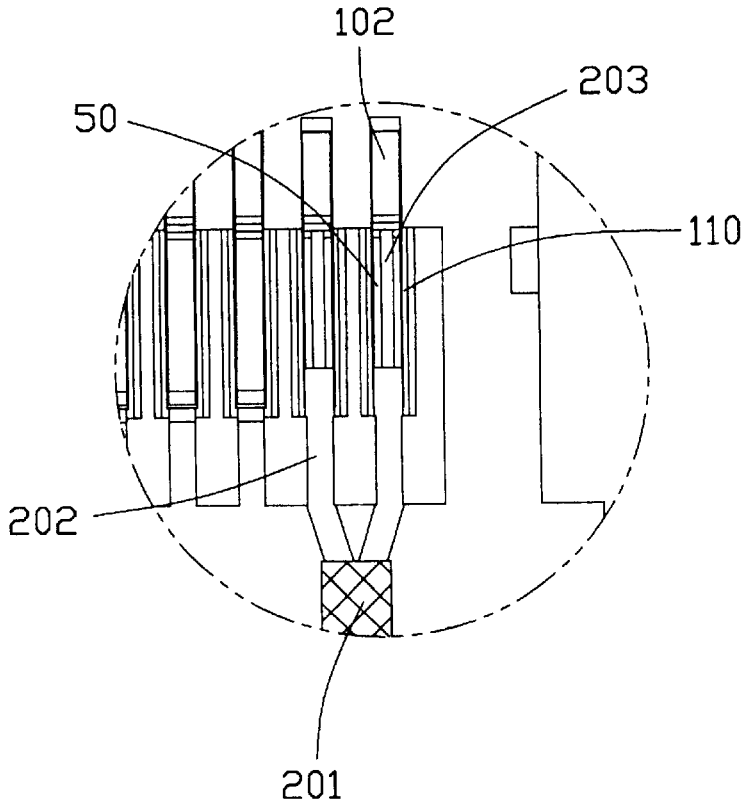
FIG. 8 is an enlarged view of a circled portion of FIG. 7.

Referring to FIG. 7, the first and second wires 20, 22 each comprise a pair of conductors 203 each electrically connecting with the terminal 102, an insulation 202 surrounding the conductor 203, a metal braiding 201 surrounding the insulation 202 and a jacket (not labeled) surrounding the braiding 201. The first wires 20 are respectively inserted into the grooves 106. The second wires 22 are inserted in the channel 107. The wires 20, 22 are horizontally extended in the connector 10. The bottom of the connector 10 defines a plurality of canals 110 with the terminals 102 exposing to the canals 110 and the conductors 203 of the first wires 20 located in the canals 110. A number of solder slugs 50 are positioned into the canals 110, whereby when the connector assembly 1 is subject to heat, the solder slugs 50 are melted to solder the terminals 102 and the conductors 203 of the first and second wires 20, 22 together (referring to FIG. 6).

Figure 9:
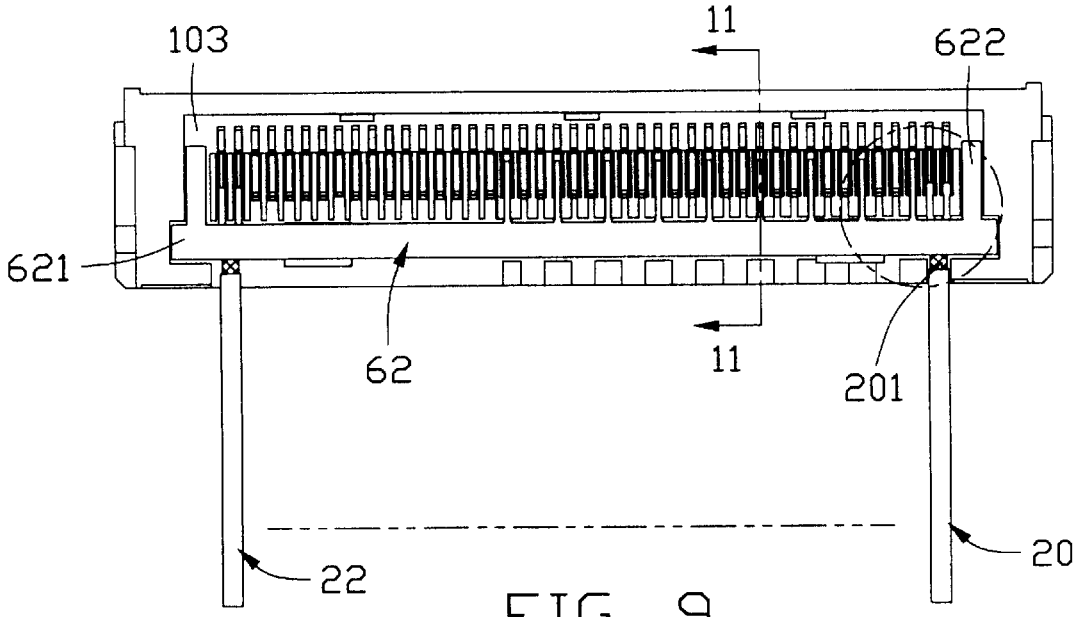
FIG. 9 is a bottom plan view of a micro coaxial cable connector assembly in accordance with a second preferred embodiment of the present invention in which upper and lower grounding shields of the assembly being removed for clarity.
Figure 10:
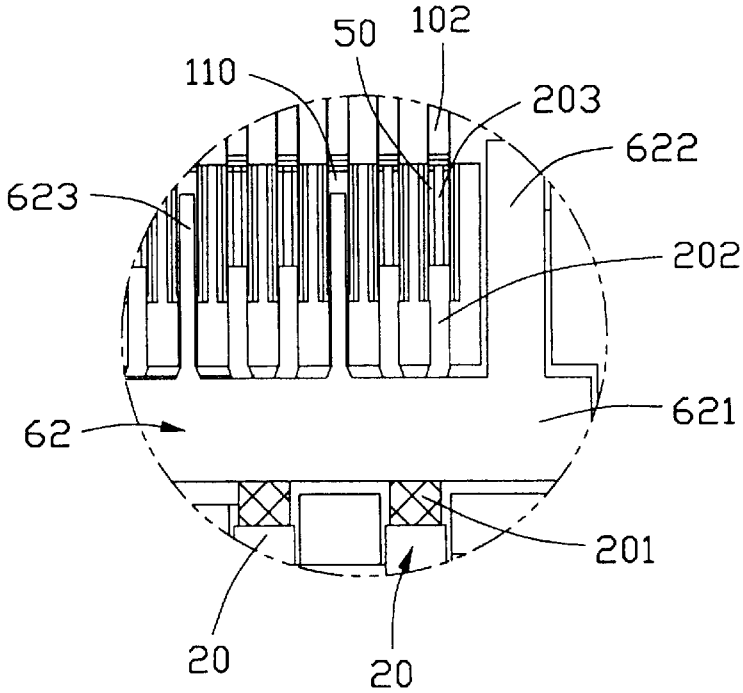
FIG. 10 is an enlarged view of a circled portion of FIG. 7.
Figure 11:
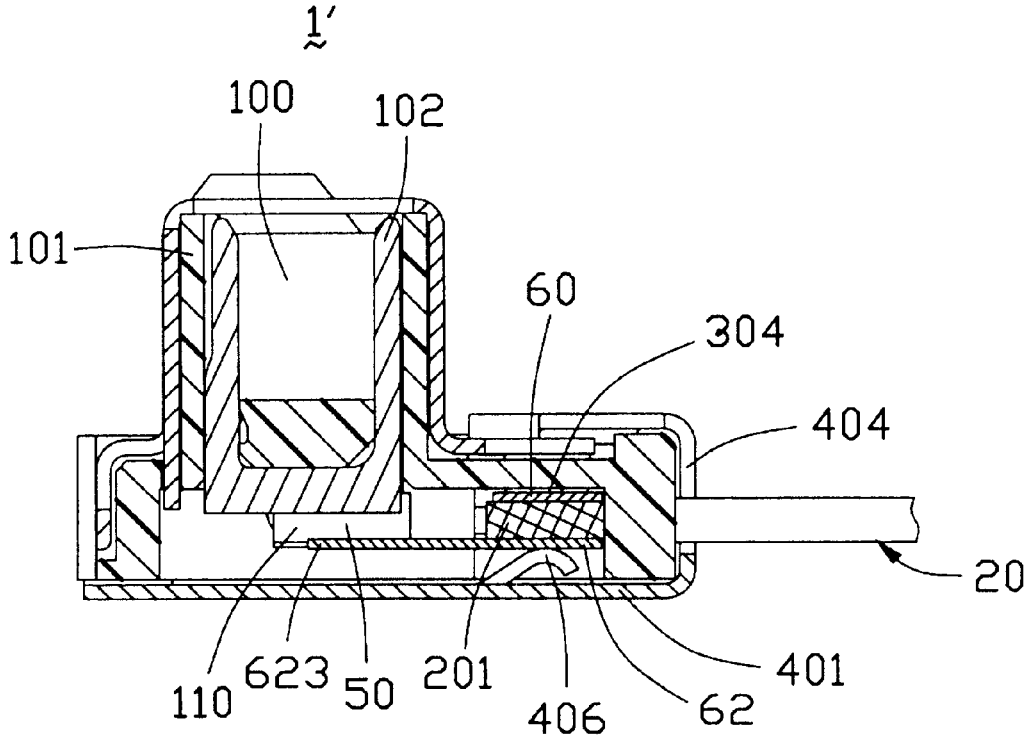
FIG. 11 is a cross-sectional view of the micro coaxial cable connector taken along line 11—11 of FIG. 9.

Further referring to FIGS. 9 to 11, a micro coaxial cable connector assembly 1' in accordance with a second preferred embodiment of the present invention is shown, Same, components in the two embodiments are labeled by the same reference number. The micro coaxial cable connector assembly 1' has a structure substantially the same as that of the micro coaxial cable connector assembly 1 of the first embodiment, except that the former further has top and bottom grounding bars 60, 62. The bottom grounding bar 62 is received in the bottom of the base 103 and comprises a rectangular portion 621 and a pair of strips 622 extending from two sides of the rectangular portion 621. A plurality of grounding fingers 623 extends from the rectangular portion 621 into selected ones of the canals 110 of the base 103 to be soldered to grounding terminals of the terminals 102. The grounding terminals are located between signal terminals connecting with the conductors 203 of two neighboring first wires 20. The top grounding bar 60 has a similar configuration of the bottom grounding bar but does not have the grounding fingers.

In assembly, the top grounding bar 60 is first positioned in the bottom of the base 103 and the first and second wires 20, 22 positioned on the top grounding bar 60 with the braiding 201 of the wires 20, 22 electrically engaging with the top grounding bar 60. The bottom grounding bar 62 is then put on the first and second wires 20, 22 and engaged with the braiding 201 thereof. A heat is applied to the connector subassembly to melt the solder slugs 50 in the canals 110, thereby soldering the terminals 102 and the conductors 203 of the first and second wires 20, 22 and the grounding fingers 623 together Finally, the upper grounding shield 30 is assembled to the mating portion 101 in a manner like the first embodiment with the spring tags 304 of the upper grounding shield 30 extending into the recesses 104 and electrically engaging with the top grounding bar 60. The lower grounding shield 40 is assembled to the base 103 and the upper grounding shield 30 in a manner like the first embodiment, with the tags 406 electrically engaging with the bottom grounding bar 62. The two grounding bars 60, 62 are electrically connected with the braiding 201 of the wires 20, 22. So a grounding path between the upper grounding shield 30, the top grounding bar 60, the bottom grounding bar 62 and the lower grounding shield 40 is established.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A micro coaxial cable connector assembly comprising:

a connector comprising a mating portion defining a recess adapted for receiving a complementary connector, said recess opening in a first direction and a base perpendicular to the mating portion, the base defining a plurality of canals;

a plurality of signal and grounding terminals received in the mating portion and further extending into the canals;

a plurality of wires assembled to the base and each wire comprising a conductor extending into a corresponding canal in a second direction and a metal braiding surrounding the conductor, the first direction being perpendicular to the second direction, the conductors and the signal terminals being soldered together in the canal;

a conductive grounding shield enclosing the connector; and a grounding bar electrically connecting the metal braiding and comprising a plurality of grounding fingers extending into selected canals with the grounding terminals extending therein, the grounding fingers electrically connecting with the grounding terminals;

wherein the grounding terminals each are located between signal terminals connecting with the conductors of two neighboring wires;

wherein each wire further comprises an insulation surrounding the conductor and a jacket, the metal braiding surrounding the insulation and the jacket surrounding the metal braiding;

further comprising another grounding bar electrically connecting with the metal braiding of the wire;

wherein the grounding bar is received in the bottom of the base and comprises a rectangular portion from which the grounding fingers extend and a pair of strips extending from two sides of the rectangular portion;

wherein the conductive grounding shield comprises an upper grounding shield assembled to the mating portion of the connector in the first direction and a lower grounding shield assembled to the base of the connector in the second direction;

wherein the upper grounding shield having a flat portion located on the base and the lower grounding shield having a pressing portion pressing against and electrically connecting with the flat portion;

wherein the base comprises a slot and the pressing portion of the lower grounding shield has a latch assembled to the slot;

wherein the base comprises a protrusion and the lower grounding shield has a buckling portion assembled to the protrusion so that the lower grounding shield and the connector are securely assembled together;

wherein the upper grounding shield comprises a vertical portion covering a rear side of the base;

wherein the base defines a recess and the upper grounding shield comprises a spring tag received into the recess;

wherein the wires are grouped into power transmitting wires and signal transmitting wires, and the base defines a plurality of grooves receiving the signal transmitting wires and a channel beside the grooves, the channel receiving the power transmitting wires.

* * * * *